US007387351B2

(12) United States Patent
Nam

(10) Patent No.: US 7,387,351 B2
(45) Date of Patent: Jun. 17, 2008

(54) STORAGE DEVICE AND DOOR HOLDER FOR SAME

(75) Inventor: Jeong-man Nam, Kwangju-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 459 days.

(21) Appl. No.: 10/980,846

(22) Filed: Nov. 4, 2004

(65) Prior Publication Data

US 2005/0127683 A1 Jun. 16, 2005

(30) Foreign Application Priority Data

Dec. 11, 2003 (KR) ..... 10-2003-0090282

(51) Int. Cl.
*A47B 88/00* (2006.01)

(52) U.S. Cl. ..... 312/402; 312/333; 292/23; 292/121

(58) Field of Classification Search ..... 312/401, 312/402, 404, 330.1, 333, 334.7, 350; 292/247, 292/12, 15, 23, 95, 121, 128, 101, 102, 108
See application file for complete search history.

(56) References Cited

U.S. PATENT DOCUMENTS

| | | | | |
|---|---|---|---|---|
| 2,711,944 | A * | 6/1955 | Meek et al. | 312/333 |
| 3,355,207 | A * | 11/1967 | Newman | 292/78 |
| 5,120,118 | A * | 6/1992 | Rankin | 312/402 |
| 5,518,282 | A * | 5/1996 | Sawada | 292/252 |

FOREIGN PATENT DOCUMENTS

| | | |
|---|---|---|
| CN | 2271309 Y | 12/1997 |
| EP | 0 656 182 A1 | 7/1995 |
| JP | 01-181083 | 7/1989 |
| JP | 01-219487 | 9/1989 |
| JP | 10-54655 | 2/1998 |
| JP | 10-300334 | 11/1998 |
| JP | 11-6683 | 1/1999 |
| JP | 11-101575 | 4/1999 |
| JP | 11-118320 | 4/1999 |
| JP | 11-201625 | 7/1999 |
| JP | 11-218380 | 8/1999 |
| KR | 2002-88283 | 11/2002 |
| KR | 2003-53872 | 7/2003 |
| KR | 2003-79522 | 10/2003 |
| KR | 10-406041 | 11/2003 |
| KR | 10-2005-0052709 | 6/2005 |

* cited by examiner

*Primary Examiner*—James O Hansen
(74) *Attorney, Agent, or Firm*—Staas & Halsey LLP

(57) ABSTRACT

A storage device including: a body having a storage compartment with an opening; and a door assembly accommodated in the storage compartment to slidably open/close the opening; and a door holding device. The door holding device includes a hooking part on one of the door assembly and the body to prevent a sliding of the door assembly when the door assembly opens/closes the opening, and a hook on the other one of the door assembly and the main body and which rotates between a first position at which the hook is hooked with the hooking part when the door assembly closes the opening and a second position at which the hook is released from the hooking part when the door assembly opens the opening.

25 Claims, 10 Drawing Sheets

STORAGE DEVICE AND DOOR HOLDER FOR SAME

CROSS-REFERENCE TO RELATED APPLICATION

This application claims the benefit of Korean Patent Application No. 2003-090282, filed on Dec. 11, 2003, in the Korean Intellectual Property Office, the disclosure of which is incorporated herein by reference.

BACKGROUND OF THE INVENTION

1. Field of the Invention

The present invention relates to a storage, and more particularly, to a storage device having an improved door holding device to prevent a sliding of a door assembly when a door assembly slidably opens/closes an opening.

2. Description of the Related Art

Throughout the disclosure that follows, a Kimchi refrigerator is used as an example of a storage device to which the present invention is applicable. However, it is to be understood that the present invention is not limited to use with such devices. Instead, it is contemplated that the present invention may be used in myriad devices having a drawer, such as, by way of a non-limiting example, furniture.

The Kimchi refrigerator is used to ferment and mature Kimchi for a specified period of time or to store Kimchi for a long time at a constant temperature.

The Kimchi refrigerator is divided into a top opening type and a drawn type according to a method of opening. The top opening type comprises an opening formed on a top of a main body and a door to open/close the opening, which has an advantage to store Kimchi but a disadvantage to draw out containers that are layered one on one. The drawn type comprises a drawer type door to open/close a front opening and the drawer type doors slide containers for food, which has an advantage with draw out containers but a disadvantage in that much refrigerating air flows out.

To decrease outflow of refrigerating air and prevent an inflow of unrefrigerated air, a conventional Kimchi refrigerator provides a device to open/close the door using an electromagnet as disclosed in Korean patent first publication No. 2003-32340.

The device to open/close the door disclosed in Korean patent first publication No. 2003-32340 comprises a sealing member provided at a part of the door to seal the door to the main body when the door contacts to the main body, an electromagnet provided inside of the sealing member, a power supply to supply electric power to the electromagnet and an operating switch to control electric power from the power supply to the electromagnet according to whether the door is opened or closed. Here, the operating switch is provided on a handle.

However, the conventional device to open/close the door has a complicated system, because electric power is supplied from the power supply to the electromagnet to control intensity of magnetic force of the electromagnet according to whether the door is opened or closed.

SUMMARY OF THE INVENTION

Accordingly, it is an aspect of the present invention to provide a storage having a door holding device to make the door assembly and a main body airtight with a simple structure.

According to an aspect of the present invention, there is provided a storage device including: a body having a storage compartment with an opening; and a door assembly accommodated in the storage compartment to slidably open/close the opening; and a door holding device. The door holding device includes a hooking part on one of the door assembly and the body to prevent a sliding of the door assembly when the door assembly opens/closes the opening, and a hook on the other one of the door assembly and the main body and which rotates between a first position at which the hook is hooked with the hooking part when the door assembly closes the opening and a second position at which the hook is released from the hooking part when the door assembly opens the opening.

The door holding device may include a hinge shaft which rotatably supports the hook, and the hook may be on a side of the main body forming the storage compartment which rotates with respect to the hinge shaft.

The door holding device may include an elastic member to elastically rotate the hook with respect to the hinge shaft.

The door holding device may include a roller between the hook and the elastic member to rollingly contact a part of the hook when the hook rotates with respect to the hooking part.

The hook may include: an accommodating part having an accommodating groove to accommodate the hooking part; a rotation supporting part that extends from the accommodating part and is formed with a hinge shaft accommodating hole to accommodate the hinge shaft; a first roller contacting part formed on a circumferential surface to contact the roller when the hook is in the first position; and a second roller contacting part proximate to the first roller contacting part and contacts to the roller to support the hook in the second position.

When the door assembly closes the opening but the roller still contacts to the first roller contacting part, the hook may rotate and the hooking part may push the accommodating part so that the accommodating part is accommodated in the accommodating groove.

The hook may include a third roller contacting part proximate to the first roller contacting part and by which the hook contacts to the roller when the hook rotates with respect to the hooking part.

The door holding device may include a supporting bracket provided on a side of the main body to rotatably support the hook.

A side of the roller may have a roller shaft to rotatably support the roller and a surface of the supporting bracket may have a roller shaft accommodating slit in which the roller shaft moves according to a rotation of the hook.

The roller may be made of polyacetal having a low coefficient of elasticity.

The elastic member may have a coil spring having a first end connected to the roller and a second end connected to the supporting bracket.

The supporting bracket may have a first stopper to prevent a rotation of the hook when the hook is in the first position and a second stopper to prevent a rotation of the hook when the hook is in the second position.

The hook may include: an accommodating part having an accommodating groove to accommodate the hooking part; a rotation supporting part extending from the accommodating part and having a hinge shaft accommodating hole to accommodate the hinge shaft; a first protruding part extending from the rotation supporting part to contact the first stopper when the hook is in the first position; and a second protruding part extending from the rotation supporting part to contact to the second stopper when the hook is in the second position.

According to another aspect of the present invention, there is provided a door holding device for a door assembly which opens/closes an opening in the main body of an enclosure, including: a hooking part disposed on one of the door assembly and the main body to prevent the door assembly from sliding when the door assembly opens/closes the opening; and a hook on the other one of the door assembly and the main body, the hook being rotatable between a first position at which the hook is hooked with the hooking part when the door assembly closes the opening and a second position at which the hook is released from the hooking part when the door assembly opens the opening.

Additional and/or other aspects and advantages of the present invention will be set forth in part in the description which follows and, in part, will be obvious from the description, or may be learned by practice of the invention.

BRIEF DESCRIPTION OF THE DRAWINGS

These and/or other aspects and advantages of the present invention will become apparent and more readily appreciated from the following detailed description, taken in conjunction with the accompanying drawings of which.

DETAILED DESCRIPTION OF EMBODIMENTS

Figure 1:
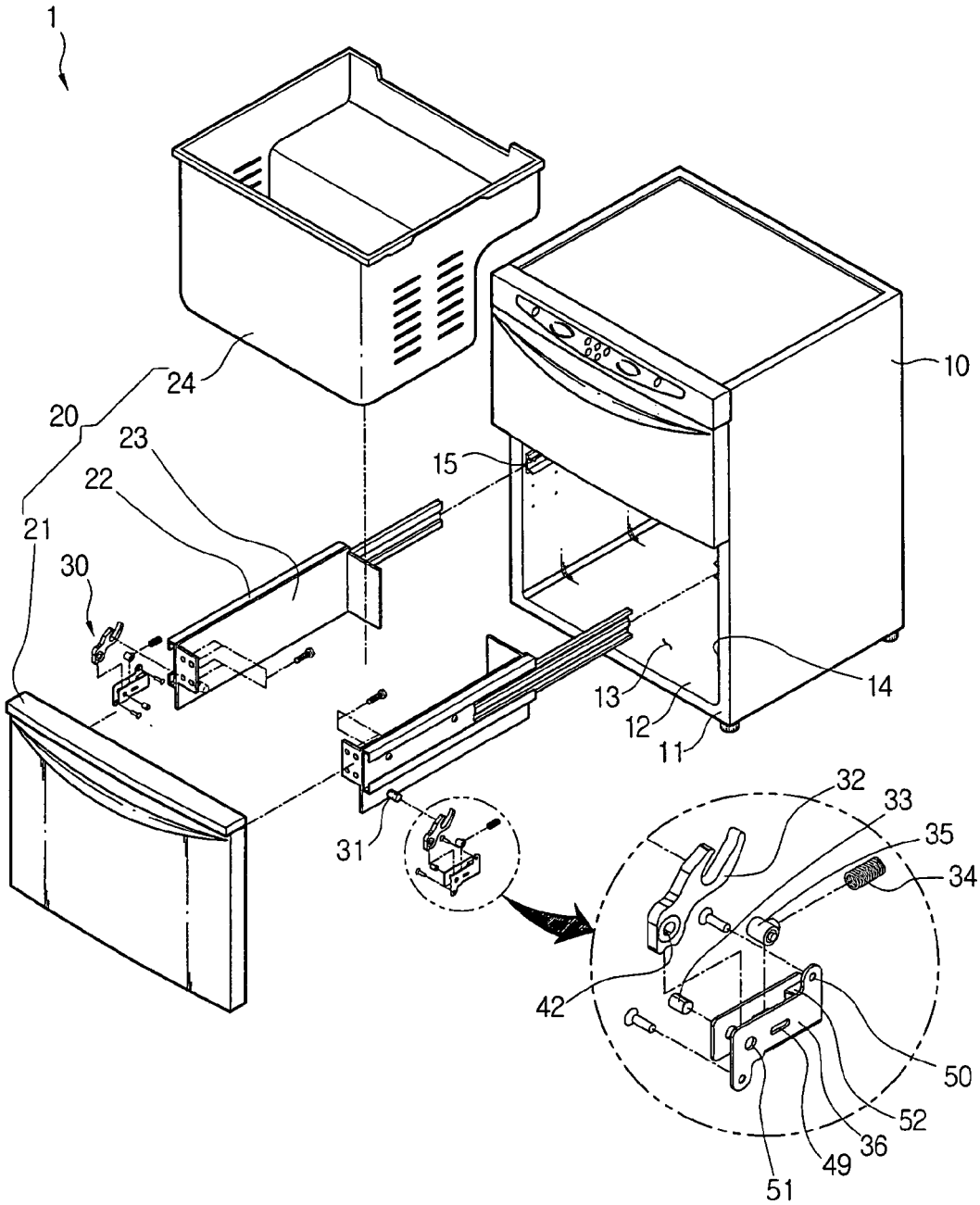
FIG. 1 is an exploded perspective view of a Kimchi refrigerator according to a first embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

Figure 2:
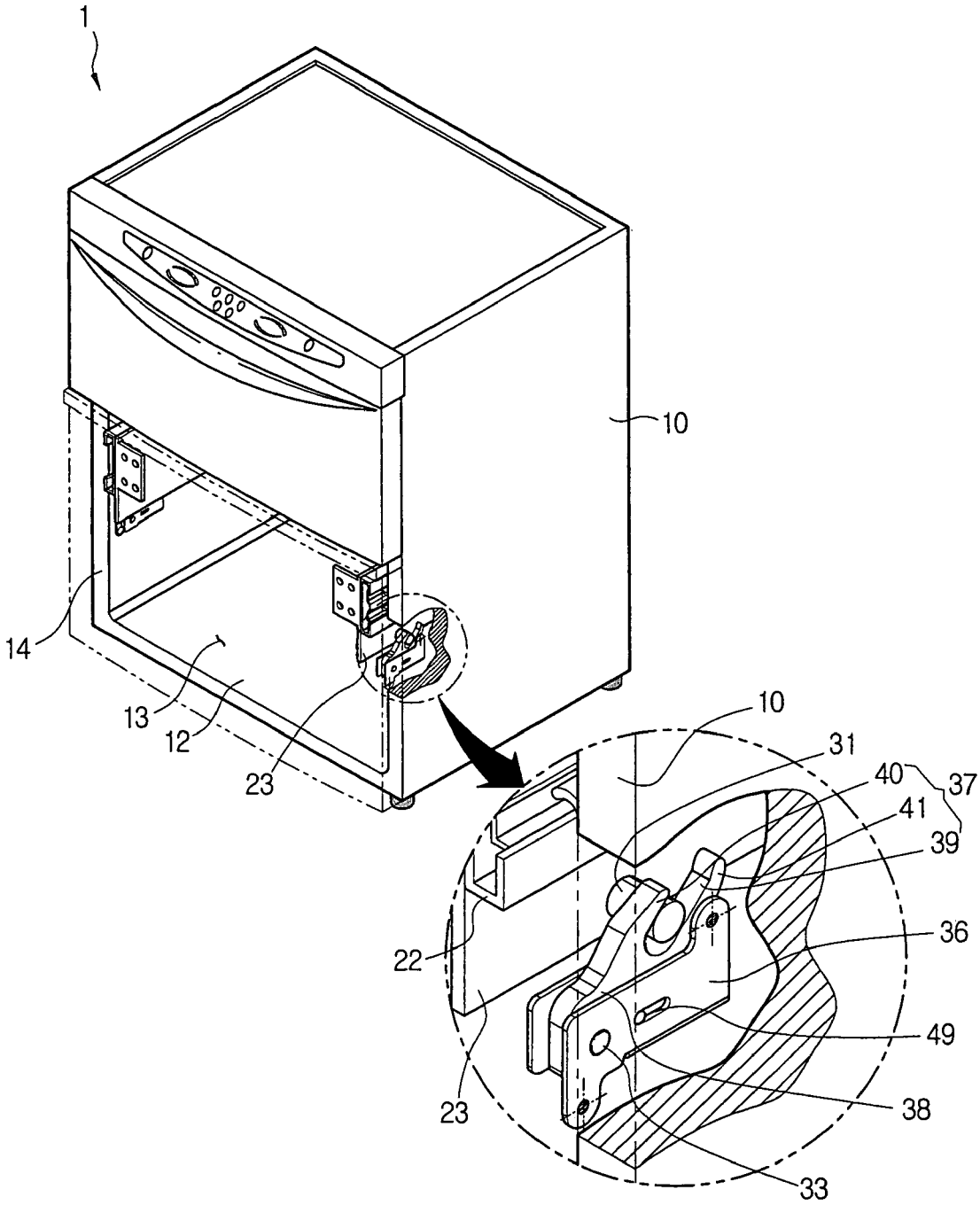
FIG. 2 is a combined perspective view illustrating a door holding device of the Kimchi refrigerator in FIG. 1.

Referring to FIGS. 1 through 2, a Kimchi refrigerator according to an embodiment of the present invention includes: a main body 10 having the storage compartment 13 and an opening 14 formed at the front of the storage compartment 13, a door assembly 20 accommodated in the storage compartment 13 of the main body 10 to slidably open/close the opening 14 and a door holding device 30 to hold a sliding of the door assembly 20 when the door assembly 20 slidably opens/closes the opening 14.

The main body 10 includes an outer casing 11 forming an external appearance and an inner casing 12 provided inside the outer casing 11 with a foaming material layer between the outer casing 11 and forming the storage compartment 13 to accommodate the door assembly 20.

Guide rails 15 are provided at opposite sides of the inner casing 12 corresponding to a pair of sliders 22 (to be described later) to slide the door assembly 20 through the opening 14.

The door assembly 20 includes a door 21 provided at a front of the door assembly 20, the pair of sliders 22 provided at opposite sides of the door 21 to slide the door assembly 20 into/out of the storage compartment 13 and a pair of mounting brackets 23 each connected to inside each of the pair of the sliders to accommodate a container 24.

The slider 22 slides along the guide rail 15 provided at the opposite sides of the inner casing 12 and includes a roller having a plurality of rolling bowls, thereby rolling-contacting with the guide rail 15.

The door holding device 30 includes a hooking part 31 provided on one of the door assembly 20 and the main body 10 and a hook 32 that is provided on the other one of the door assembly 20 and the main body 10 and rotates with respect to the hooking part 31 to be hooked with/released from the hooking part 31. Here, the door holding device 30 includes a hinge shaft 33 to rotatably support the hook 32.

According a first embodiment of the present invention, the holing part 31 is provided on the mounting bracket 23 of the door assembly 20 and moves as a single body with the door assembly 20 when the door 21 opens/closes the opening 14.

The hook 32 is provided on opposite sides of the inner casing and rotates with respect to the hinge shaft 33 between a first position at which the hook is hooked with the hooking part 31 when the door assembly 20 closes the opening 14 and a second position at which the hook is released from the hooking part 31 when the door assembly 20 opens the opening 14. As shown in FIG. 2, the hook 32 includes an accommodating part 37 having an accommodating groove 39 to accommodate the hooking part 31 and a rotation supporting part 38 extending from the accommodating part 37 and having a hinge shaft accommodating hole 42 to accommodate the hinge shaft 33.

The accommodating part 37 is of an approximate U shape and includes a first contacting part 40 and a second contacting part 41 oppositely positioned with respect to the accommodating groove 39.

The first contacting part 40 is positioned at a front side of the accommodating groove 39 and shorter than the second contacting part 41. Thus, when the hook 32 is moved from the first position to the second position by the hooking part 31, the hooking part 31 pushes an inner surface of the first contacting part 40 and the pushed hook 32 rotates with respect to the hinge shaft 33.

The second contacting part 41 is positioned at a rear side of the accommodating groove 39 and longer than the first contacting part 40. Thus, when the hook 32 is moved from the second position to the first position by the hooking part 31, the hook 31 pushes an upper part of the second contacting part 41 and the pushed hook 32 rotates with respect to the hinge shaft 33.

A circumferential surface of the rotation supporting part 38 are formed with a first roller contacting part 43, a second roller contacting part 44 and a third roller contacting part 45 to contact with a roller 35 (to be described later).

The first roller contacting part 43 is grooved from the circumferential surface of the rotation supporting part 38 to contact with the roller 35 when the door assembly 20 closes the opening 14.

The second roller contacting part 44 is grooved under the first roller contacting part 43 to contact with the roller 35 when the door assembly 20 opens the opening 14. When the door assembly 20 opens the opening 14, the hook 32 moves from the first position to the second position and the roller 35 passes a first rolling guide 46 and contacts with the second roller contacting part 44 to support the hook 32.

The third roller contacting part 45 is grooved on the first roller contacting part 43 to contacts with the roller 35 when the roller 32 further rotates backwardly from the first position. That is, if the door assembly 20 closes the opening 14 when the door assembly 20 opens the opening 14 but the roller 35 still contacts with the first roller contacting part 43, the hook 32 rotates with respect to the hooking part 31 backwardly, so that the roller 35 passes the second rolling guide 47 to contact with the third roller contacting part 45.

The door holding device 30 includes an elastic member 34 to elastically rotate the hook 32.

The elastic member 34 may be a coil spring provided at the rear of the rotation supporting part 38. The coil spring may be a compression spring that can be pressed by a pressure by the hook 32 when the hook 32 rotates. However, by way of non-limiting examples, the elastic member 34 may also be a plate spring or be made of rubber.

Then, the hook 32 can elastically rotate and hold the sliding of the door assembly 20 by being hooked with/released from the hooking part 31.

Further, the door holding device 30 further includes the roller 35 to rolling-contact with a part of the hook 32. The door holding device 30 further includes a supporting brackets 36 provided on opposite sides of the main body 10 forming the storage compartment 13 to rotatably support the hook 32.

The roller 35 positioned between the hook 32 and the elastic member 34 includes a roller shaft 48 on a side thereof. By way of non-limiting example, the roller 35 may be of a cylinder shape and made of material having a small coefficient of elasticity to smoothly rolling-contact with the hook 32. Especially, the roller 35 may be injection molded with polyacetal. Thus, the first, second and third roller contacting parts 43, 44 and 45 to rolling-contact with the roller 35 may be a shape of an arc corresponding to the shape of the roller 35.

The roller shaft 48 is accommodated in a roller shaft accommodating slit 49 (to be described later) formed on a surface of the supporting bracket 36 and movable in the roller shaft accommodating hole 49 according to a rotation of the hook 32.

The supporting bracket 36 is of an approximately U shape. A surface of the supporting bracket 36 is formed with a connecting hole 50 to connect the supporting bracket 36 to the inner casing 12, a hinge hole 51 to accommodate the hinge shaft 33 and the roller shaft accommodating slit 49 to accommodate the roller shaft 48. The supporting bracket 36 includes a supporting part 52 in the vicinity of the roller 35 to accommodate a part of the elastic member 34 and support the elastic member 34.

A description of an operation of the door holding device 30 of the Kimchi refrigerator 1 according to the first embodiment of the present invention with a configuration described above follows.

Figure 3:
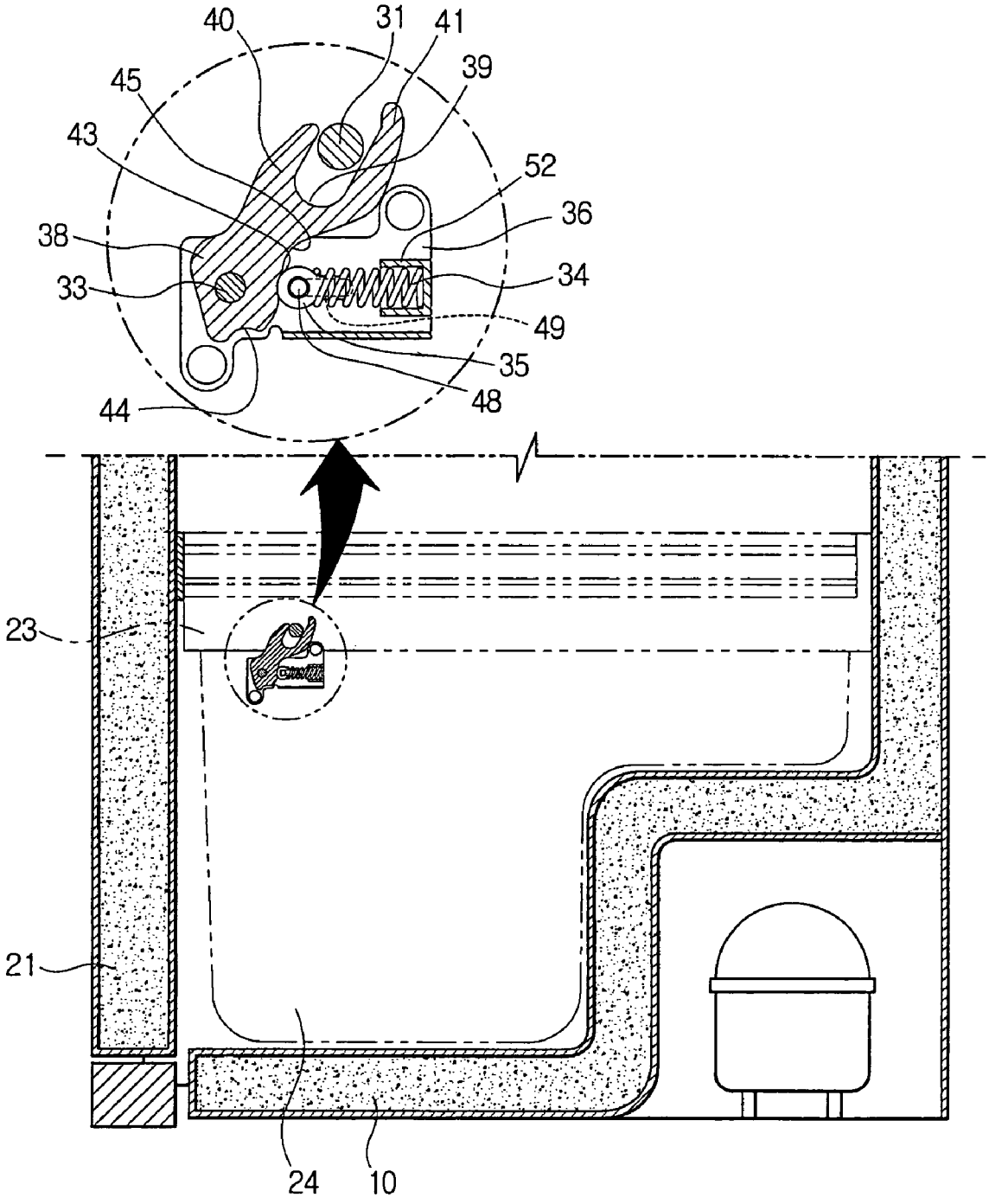
FIG. 3 through 5 show an operation of the door holding device in FIG. 2.

As shown in FIG. 3, when the door 21 closes the opening 14 (shown in FIG. 1), the hooking part 31 is accommodated in the accommodating part 37 (shown in FIG. 2) of the hook 32 (shown in FIG. 1) and the roller contacts to the first roller contacting part 43.

Figure 4:
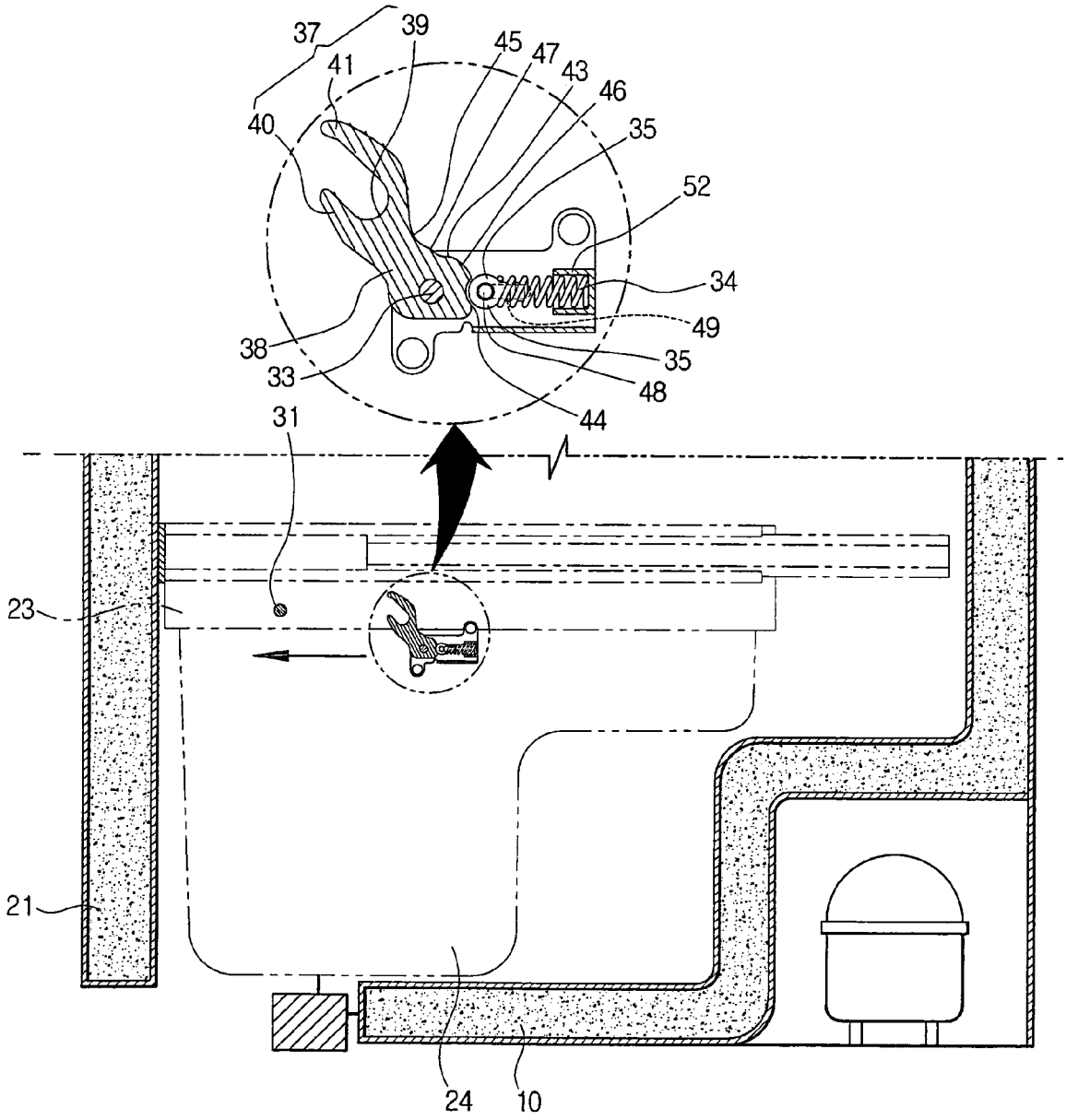

As shown in FIG. 4, if a user pulls the door 21 forwardly to draw out the door 21, the hooking part 31 moves forwardly corresponding to a moving direction of the door assembly 20 and the hook 32 rotates with respect to the hinge shaft 33 to be release from the hooking part 31. At this time, the hook 32 pushes the roller 35 and presses the elastic member 34 until the roller 35 passes the first rolling guide 46 and contacts to the second rolling-contacting part 44. The roller 35 pushed by the hook 32 moves toward the elastic member 34 inside the roller shaft accommodating slit 49 corresponding to the length by which the elastic member 34 is pressed. Then, the roller 35 returns to the former position due to a restoring force of the elastic member 34 and contacts to the second roller contacting part 44, which holds a rotation of the hook 32.

If the user slides the door 21 slid out of the main body 10 into the main body 10, the hooking part 31 moves with the door 21 and pushes the second contacting part 41 of the hook 32 to rotate the hook 32. Thus, the hooking part 31 is accommodated in the accommodating groove 39 of the hook 32 and hooked with the hook 32.

Figure 5:
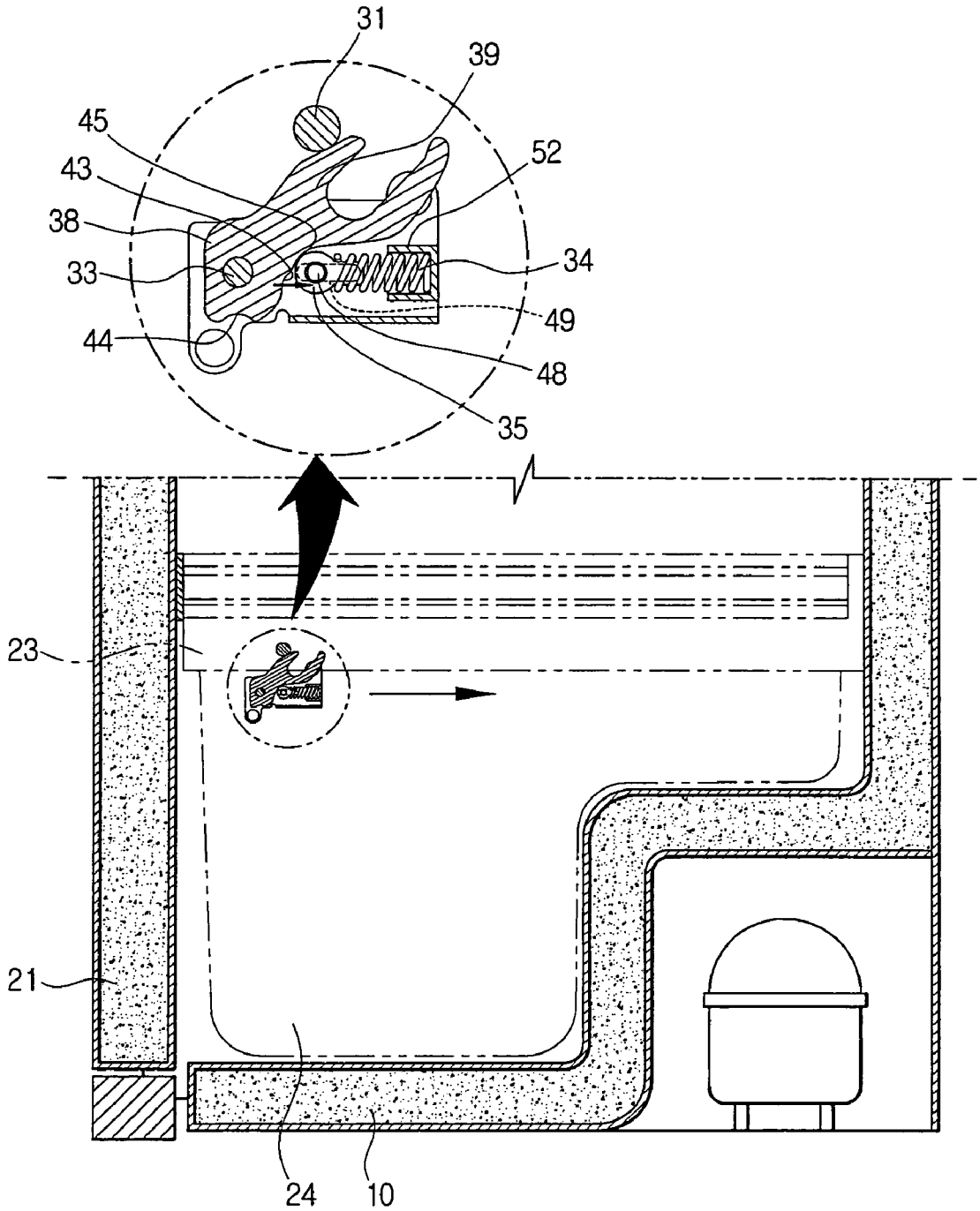

Referring to FIG. 5, if the user slides the door 21 slid out of the main body 10 backwardly into the main body 10 when the user draws out the door 21 but the roller 35 still contacts to the first roller contacting part 43, the hooking part 31 pushes an outer surface of the first contacting part 40 of the hook 32 and is accommodated in the accommodating groove 39. At this time, the hook 32 applies force on the roller 35 and presses the elastic member 34 until the roller 35 passes the second rolling guide 47 and contacts to the third roller contacting part 45. At this time, the roller 35 pushed by the hook 32 moves toward the elastic member 34 inside the roller shaft accommodating slit 49 corresponding to the length by which the elastic member 34 is pressed (shown by arrow A in FIG. 5). Then, the roller 35 contacts to the first roller contacting part 43 due to a restoring force of the elastic member 34.

Figure 6:
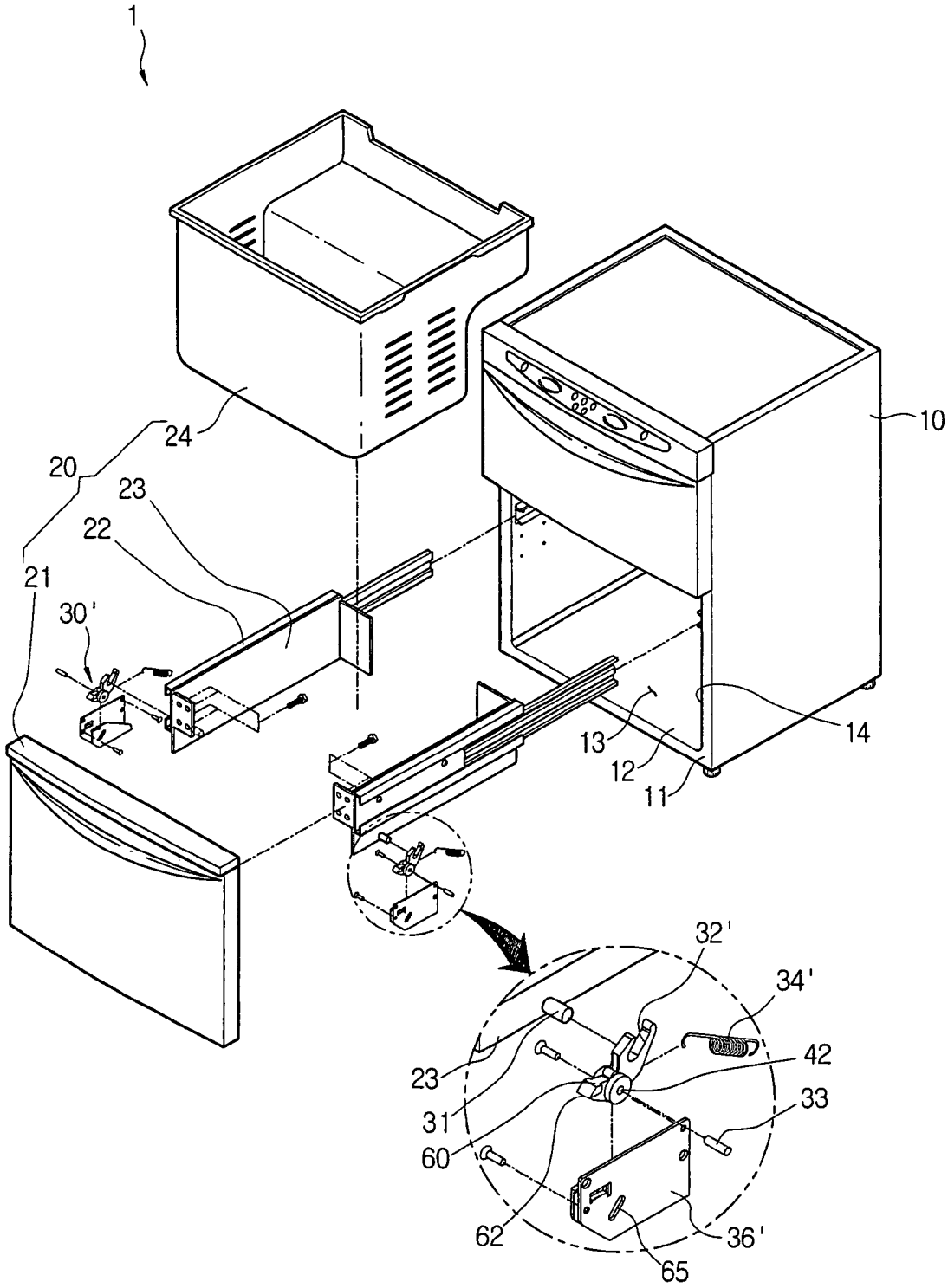
FIG. 6 is an exploded perspective view of a Kimchi refrigerator according to a second embodiment of the present invention.
Figure 7:
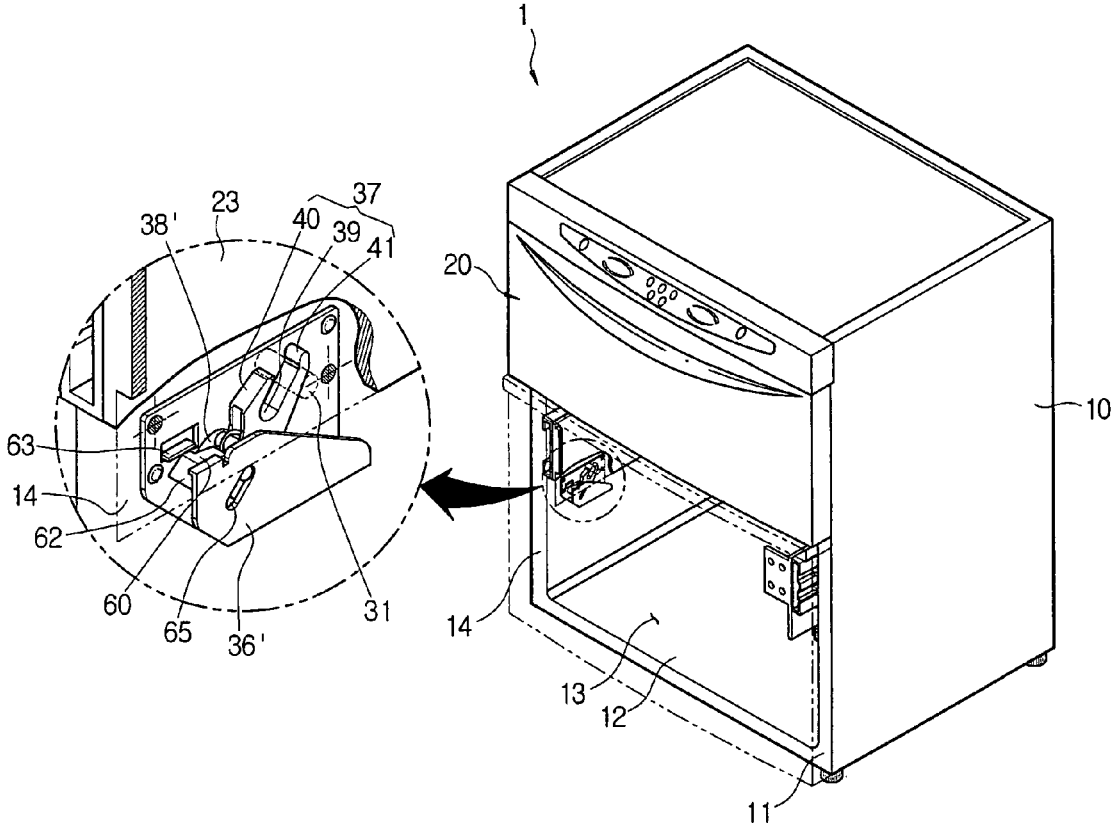
FIG. 7 a combined perspective view illustrating a door holding device of the Kimchi refrigerator in FIG. 6.

Referring to FIGS. 6 and 7, a door holding device 30' according to a second embodiment of the present invention includes a hook 32' including an accommodating part 37 having an accommodating groove 39 to accommodate a hooking part 31, a rotation supporting part 38' extending from the accommodating part 37 and having a hinge shaft accommodating hole 42 to accommodate a hinge shaft 33, a first protruding part 60 extending from the rotation supporting part 38' and a second protruding part 62 bent from the first protruding part 60.

The first protruding part 60 has a plate shape and protrudes from the front of the rotation supporting part 38' and the second protruding part 62 is bent downwardly from the first protruding part 60.

The door holding device 30' according to the second embodiment of the present invention also includes a supporting bracket 36'. The supporting bracket 36' includes a first stopper 63 to prevent a rotation of the hook 32' by contacting to the first protruding part 60 when the hook 32' is in the first position and a second stopper 63 to prevent a rotation of the hook 32' by contacting to the second protruding part 60 when the hook 32' is in the second position. The supporting bracket 36' also includes a surface having a hinge shaft accommodating slit 65 to accommodate the hinge shaft 33. By way of non-limiting example, the hinge shaft 33 may move in the hinge shaft accommodating slit 65 according to the rotation of the hook 32'. Further, the door holding device 30' also includes an elastic member 34', which may be a coil spring. The coil spring may be an extension spring having a first end connected to the supporting bracket 36' and a second end connected to the hook 32' to elastically rotate the hook 32' due to an extension force thereof.

A description of an operation of the door holding device of the Kimchi refrigerator 1 according to the second embodiment of the present invention with a configuration described above follows with concurrent reference to FIGS. 8-10.

Figure 8:
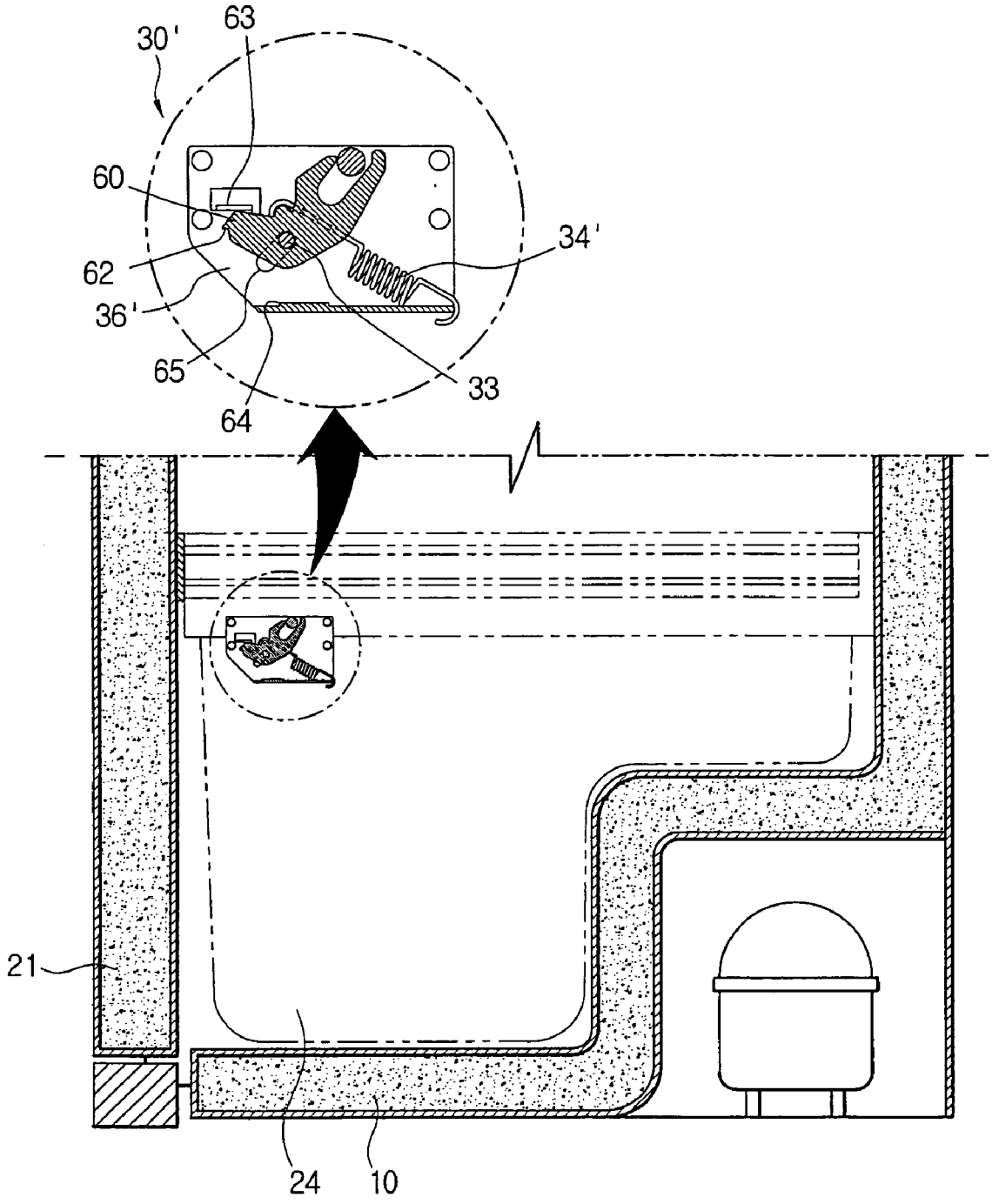
FIG. 8 through 10 show an operation of the door holding device in FIG. 7.

As shown in FIG. 8, when the door 21 closes the opening 14 of the main body 10, the hooking part 31 is accommodated in the accommodating part 37 of the hook 32' and the first stopper 63 contacts to the first protruding part 60 to prevent the rotation of the hook 32'.

Figure 9:
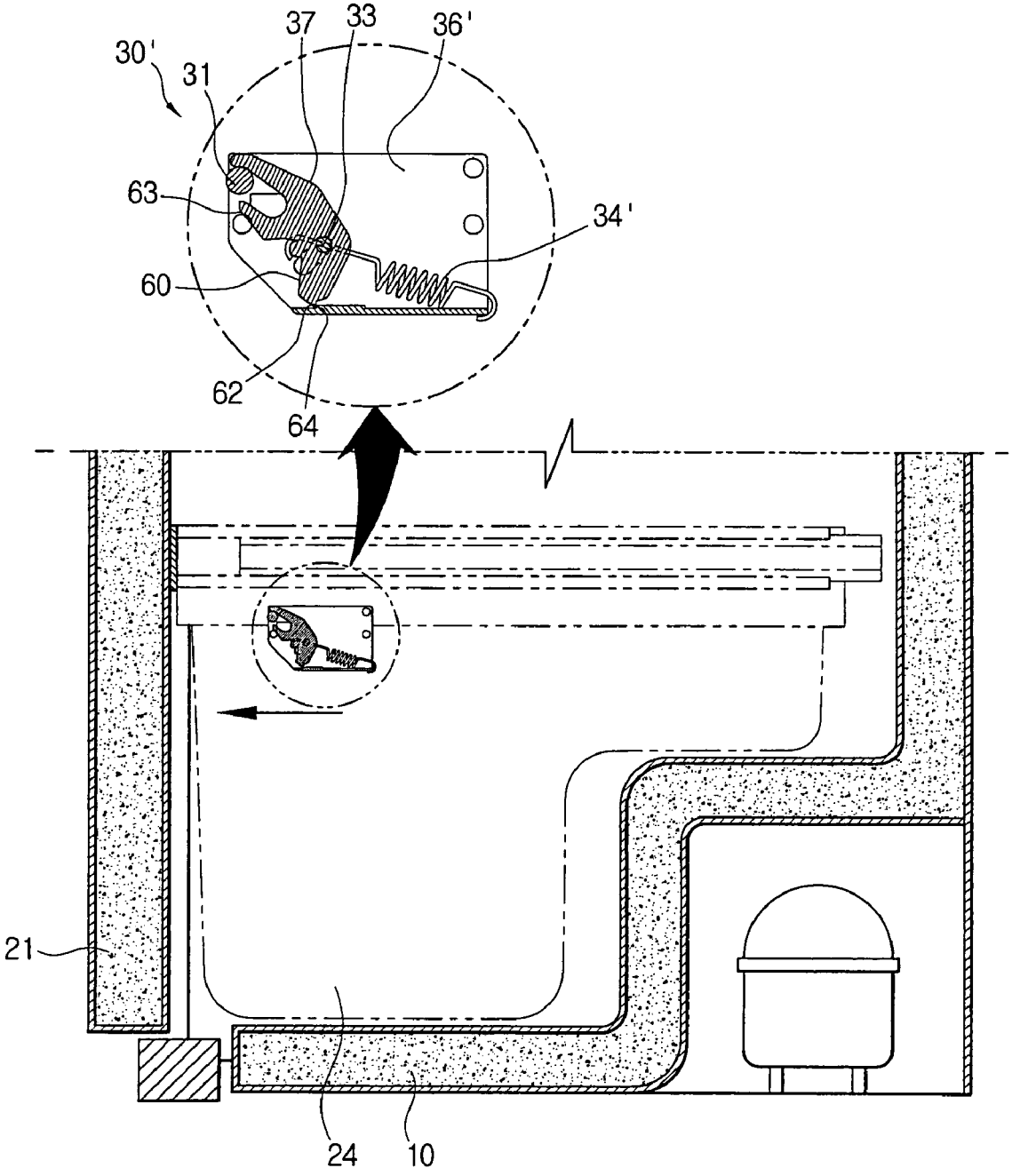

Then, as shown in FIG. 9, if a user pulls the door 21 forwardly to draw out the door 21, the hooking part 31 moves forwardly corresponding to a moving direction of the door 21 and the hook 32' rotates with respect to the hinge shaft 33 to be release from the hooking part 31. At this time, the hook 32' rotates with respect to the hinge shaft 33 and extends the elastic member 34' until the second protruding part 62 contacts to the second stopper 64. Thus, the second stopper 64 provided at a lower part of the supporting bracket 36' prevents the rotation of the hook 32'. If the user slides the door assembly 20 slid out of the main body 10 backwardly into the main body 10, the hooking part 31 moves backwardly along a moving direction of the door 21 and pushes the second contacting part 41 of the hook 32' to rotate the hook 32'. Thus, the hooking part 31 is accommodated in the accommodating groove 39 and hooked with the hook 32'.

Figure 10:
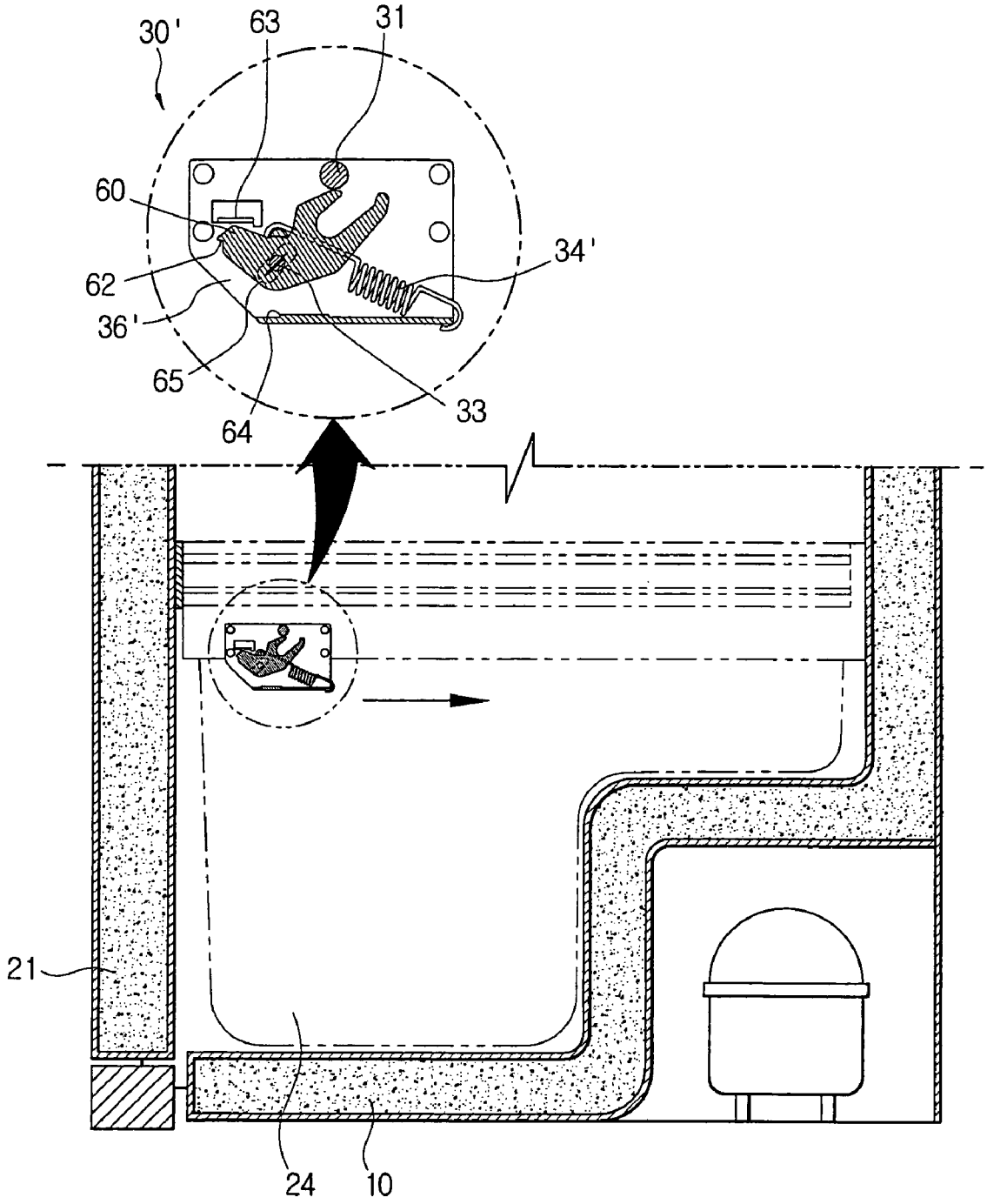

However, as shown in FIG. 10, if the user moves the door 21 backwardly toward the main body 10 when the user draws out the door 21 out of the main body 10 but the first protruding part 60 still contacts to the first stopper 63, the hooking part 31 pushes an outer surface of the first contacting part 40 of the hook 32' and is accommodated in the accommodating groove 39. At this time, the hinge shaft 33 moves downwardly in the hinge shaft accommodating slit 65, so that the hook 32' is hooked with the hooking part 31 (refer to the arrow in FIG. 6*c*). At this time, a specified force is applied on the hook 32, so that the first protruding part 60 is detached from the first stopper 63. However, the hook 32' can return to the former position due to a restoring force of the elastic force 34'.

The present invention is embodied as a Kimchi refrigerator having the door holding devices 30 and 30' in the embodiments described above but not limited thereto. However, it is to be understood that the door holding devices of the present invention may be applied to all of apparatuses having a drawer, especially to furniture.

As described above, the embodiments of the present invention provide a storage in which the main body and the door assembly are more airtight and have a simple structure.

Further, the described embodiments of the present invention provide the storage in which the hook rotates with respect to the hook to be hooked with/released from the hooking part when a user draws the door assembly out of the storage compartment, so that the structure to open/close the door is improved.

Although a few embodiments of the present invention have been shown and described, the present invention is not limited to the described embodiments. Instead, it would be appreciated by those skilled in the art that changes may be made in these embodiments without departing from the principles and spirit of the invention, the scope of which is defined by the claims and their equivalents.

What is claimed is:

1. A storage device comprising:

a main body having a storage compartment with an opening; and a door assembly accommodated in the storage compartment to slidably open/close the opening; and a door holding device including a hooking part on the door assembly to prevent a sliding of the door assembly when the door assembly opens/closes the opening, a hook on the main body a hinge shaft which rotatably supports the hook, with the hook being located on a side of the main body forming the storage compartment, wherein the hook rotates with respect to the hinge shaft between a first position at which the hook is hooked with the hooking part when the door assembly closes the opening and a second position at which the hook is released from the hooking part when the door assembly opens the opening, an elastic member to elastically rotate the hook with respect to the hinge shaft, and a roller directly connected to the elastic member and located between the hook and the elastic member to rollingly contact a part of the hook when the hook rotates with respect to the hooking part.

2. The storage device according to claim 1, wherein the hook includes:

an accommodating part having an accommodating groove to accommodate the hooking part;

a rotation supporting part that extends from the accommodating part and is formed with a hinge shaft accommodating hole to accommodate the hinge shaft;

a first roller contacting part formed on a circumferential surface to contact the roller when the hook is in the first position; and a second roller contacting part proximate to the first roller contacting part and contacts to the roller to support the hook in the second position.

3. The storage device according to claim 2, wherein, when the door assembly closes the opening but the roller still contacts to the first roller contacting part, the hook rotates and the hooking part pushes the accommodating part so that the hooking part is accommodated in the accommodating groove.

4. The storage device according to claim 3, wherein the hook includes a third roller contacting part proximate to the first roller contacting part and by which the hook contacts to the roller when the hook rotates with respect to the hooking part.

5. The storage device according to claim 4, wherein the door holding device includes a supporting bracket at a side of the main body to rotatably support the hook.

6. The storage device according to claim 5, wherein a side of the roller has a roller shaft to rotatably support the roller and a surface of the supporting bracket has a roller shaft accommodating slit in which the roller shaft moves according to a rotation of the hook.

7. The storage device according to claim 6, wherein the roller is polyacetal having a low coefficient of elasticity.

8. The storage device according to claim 7, the elastic member is a coil spring having a first end connected to the roller and a second end connected to the supporting bracket.

9. The storage device according to claim 3, wherein the door holding device includes a supporting bracket at a side of the main body to rotatably support the hook.

10. The storage device according to claim 9, wherein a side of the roller has a roller shaft to rotatably support the roller and a surface of the supporting bracket has a roller shaft accommodating slit in which the roller shaft moves according to a rotation of the hook.

11. The storage device according to claim 10, wherein the roller is made of polyacetal having a low coefficient of elasticity.

12. The storage device according to claim 11, the elastic member is a coil spring having a first end connected to the roller and a second end connected to the supporting bracket.

13. The storage device according to claim 2, wherein the door holding device includes a supporting bracket on a side of the main body to rotatably support the hook.

14. The storage device according to claim 13, wherein a side of the roller has a roller shaft to rotatably support the roller and a surface of the supporting bracket has a roller shaft accommodating slit in which the roller shaft moves according to a rotation of the hook.

15. The storage device according to claim 14, wherein the roller is made of polyacetal having a low coefficient of elasticity.

16. The storage device according to claim 15, the elastic member is a coil spring having a first end connected to the roller and a second end connected to the supporting bracket.

17. The storage device according to claim 1, wherein the door holding device includes a supporting bracket provided on a side of the main body to rotatably support the hook.

18. The storage device according to claim 17, wherein a side of the roller has a roller shaft to rotatably support the roller and a surface of the supporting bracket has a roller shaft accommodating slit in which the roller shaft moves according to a rotation of the hook.

19. The storage device according to claim 18, wherein the roller is made of polyacetal having a low coefficient of elasticity.

20. The storage device according to claim 19, the elastic member is a coil spring having a first end connected to the roller and a second end connected to the supporting bracket.

21. A door holding device for a door assembly which opens/closes an opening in, a main body of an enclosure, comprising:

a hooking part disposed on, the door assembly, to prevent the door assembly from sliding when the door assembly opens/closes the opening;

a hook on the, main body;

a hinge shaft which rotatably supports the hook, with the hook being located, on a side of the main body forming the storage compartment, wherein the hook, rotates with respect to the hinge shaft between a first position at which the hook is hooked with the looking part when the door assembly closes the opening and a second position at which the hook is released from the hooking part when the door assembly opens the opening;

an elastic member to elastically rotate the hook with respect to the hinge shaft; and a roller directly connected to the elastic member and located between the hook and the elastic member to rollingly contact a part of the hook when the hook rotates with respect to the hooking part.

22. The storage device according to claim 21, wherein the door holding device includes a supporting bracket provided on a side of the main body to rotatably support the hook.

23. The storage device according to claim 22, wherein the elastic member is a coil spring having a first end connected to the roller and a second end connected to the supporting bracket.

24. The door holding device of claim 21, wherein the main body includes an outer casing forming an external appearance and an inner casing inside the outer casing forming the storage compartment which accommodates the door assembly.

25. The door holding device of claim 24, wherein the enclosure includes guide rails at opposite sides of the inner casing, and wherein the door assembly includes a door at a front of the door assembly, a pair of sliders at opposite sides of the door to cooperate with the guide rails to permit the door assembly to slide into/out of the storage compartment.

* * * * *

UNITED STATES PATENT AND TRADEMARK OFFICE

CERTIFICATE OF CORRECTION

PATENT NO. : 7,387,351 B2
APPLICATION NO. : 10/980846
DATED : June 17, 2008
INVENTOR(S) : Jeong-man Nam It is certified that error appears in the above-identified patent and that said Letters Patent is hereby corrected as shown below:

Column 8, Line 1, after “body” insert --,--.

Column 9, Line 30, after “in” delete “,”.

Column 9, Line 32, after “on” delete “,”.

Column 9, Line 32, after “assembly” delete “,”.

Column 9, Line 35, after “the” delete “,”.

Column 10, Line 2, after “located” delete “,”.

Column 10, Line 3, after “hook” delete “,”.

Column 10, Line 5, change “looking” to --hooking--.

Signed and Sealed this

Seventh Day of October, 2008

JON W. DUDAS
*Director of the United States Patent and Trademark Office*